United States Patent [19]

Hansen

[11] 4,312,209

[45] Jan. 26, 1982

[54] METHOD FOR OPERATING A STRIP ROLLING MILL

[75] Inventor: Manfred Hansen, Düsseldorf, Fed. Rep. of Germany

[73] Assignee: Sack GmbH, Düsseldorf, Fed. Rep. of Germany

[21] Appl. No.: 151,335

[22] Filed: May 19, 1980

[51] Int. Cl.[3] ..... B21B 31/32

[52] U.S. Cl. ..... 72/237; 72/245

[58] Field of Search ..... 72/237, 245, 246, 241

[56] References Cited

U.S. PATENT DOCUMENTS 1,887,870 11/1932 Coe ..... 72/245 X 3,302,435 2/1967 Lyle et al. ..... 72/245

3,818,742 6/1974 Maltby et al. ..... 72/237 X

FOREIGN PATENT DOCUMENTS 725731 4/1980 U.S.S.R. ..... 72/245

*Primary Examiner*—Milton S. Mehr

*Attorney, Agent, or Firm*—John J. Dennemeyer

[57] ABSTRACT

A method for the operation of rolling mills, which rolls are guided by means of chocks with clearance in the window openings of the uprights. Prior to the appearance of rolling force the chocks (3) are thrust laterally and against their guide surfaces in the uprights the direction of the rolling force component which is oriented in the rolling direction. The rolling operation is then initiated after which the lateral force is removed.

4 Claims, 1 Drawing Figure

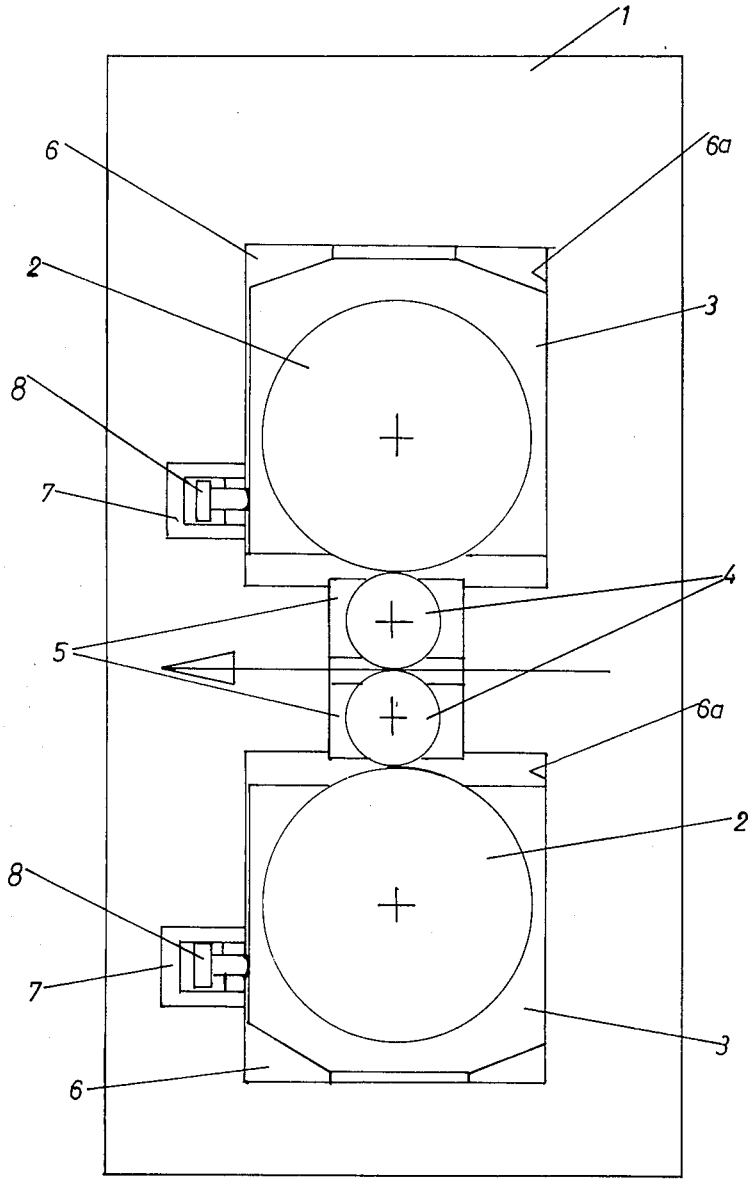
1
6
6a
2
3
8
7
4
5
6a
2
8
7
3
6

METHOD FOR OPERATING A STRIP ROLLING MILL

BACKGROUND OF THE INVENTION

1. Field of the Invention

The invention relates to a method for operating a rolling mill, more particularly a strip mill, comprising, for example, a plurality of two-high or four-high roll stands in serial configuration.

2. Discussion of Related Art

The rolls associated with a rolling mill must be aligned parallel along the vertical and horizontal axis in order to produce a perfect product. It has been found, more particularly in strip rolling, that this requirement, which initially appears to be simple, can be satisfied only with substantial expenditure in terms of rolling mill precision in the light of rising demands made on the final product.

It is known that the difficulties become very great with very thin strips, since even a very slight offset in the shaft angle between the rolls results in changes of camber, which are large in relation to the strip thickness. Clearance alone between the chocks and the uprights of conventional four-high stands, due to bearing temperature rise, can amount up to 2 mm. As a result, the shaft angle of the rolls is offset in an extreme case by 4–5 mm and this can lead to a substantial change of pressure distribution in the roll gap. Initially, the operating personnel cannot readily recognise the resultant diagonal and transverse stresses in the tightly tensioned strip. It is only subsequently, in the absence of tension, that such stresses manifest themselves by bulges in the sheet metal.

Backing rolls and work rolls have been installed in offset configuration in the roll stand in accordance with the expected offset in the running direction of the rolled stock in order to counteract the offset of the roll shaft angles and therefore the stresses, which occur in the strip, without however obtaining a precise relative position between the roll axes in the subsequent rolling operation. The desired results could not be achieved even by the use of additional roll flexing devices.

SUMMARY OF THE INVENTION

It is the object of the invention to install the rolling mill rolls together with their chocks into a roll stand, so that during the rolling operation the vertical axes of the rolling mill rolls are always aligned along the vertical plane.

This object is fulfilled, according to the invention, by a method in which prior to the appearance of rolling force, the chocks of the two-high roll or the backing roll chocks in the four-high stand are brought to bear in slack-free and defined manner against the upright side situated in the direction of the transverse force component due to the rolling force and during rolling operation said chocks are retained in the said defined position solely by the force obtained from the rolling operation. A device for performing the method is so constructed that at least one adjusting jack, provided on one side of the upright, is associated with each chock.

Surprisingly it was found that if the roll chocks are thrust against a preselected upright side, in defined manner prior to the rolling operation and the rolls are therefore precisely aligned with respect to each other, the force obtained from the ensueing rolling operation is sufficient to retain the roll chocks in this defined position. The force which can be obtained from the rolling force is however not sufficient for a specific offset between mill rolls, installed with offset shaft angles into a stand, to forcibly cause the chocks to bear against one upright side or one upright window side in the ensueing rolling operation. This applies particularly to two-high stands, in which it is in any case not possible to obtain a force in the rolling direction from the rolling force. Adjustable jacks, which can be biased, extend by means of their pistons from one side into the upright windows and cause the chocks in the upright windows to bear against the oppositely disposed upright side and are employed to thrust the roll chocks against the preselected upright side. Thereafter, the pistons are retracted so that no additional force, which might have an adverse effect on any gage control, can act against the chocks during the rolling operation.

Jacks, whose pistons extend into the upright windows, are known (French patent specification No. 1 503 319). Known jacks however are not provided to cause a chock to bear in a defined manner against one upright side. Instead, jacks are provided which are associated exclusively with the top backing roll chock, namely in oppositely oriented flush alignment, so that when the jacks are biased, the pistons extend from each upright side into the upright window and stress the chock in the upright window between them. Hydraulic interlocking of the top backing roll chock is intended to facilitate changing of the working rolls.

BRIEF DESCRIPTION OF THE DRAWING

The accompanying drawing shows a portion of a four high roll stand operated by the method of the present invention.

DESCRIPTION OF THE PREFERRED EMBODIMENT

The invention will now be explained by reference to a preferred embodiment illustrated in the accompanying drawing. Only one upright 1 of the two uprights of a four-high stand is shown. The backing rolls 2 are supported in chocks 3 and the working rolls 4 are supported in chocks 5 situated in windows 6 of the uprights 1. Furthermore, one side of the uprights is advantageously provided with hydraulic adjustable jacks 7, each associated with the chocks 3 of the backing rolls 2 and, on being biased, adapted to thrust by means of their pistons 8, which then extend into the upright windows 6, against the chocks until these bear reliably on the surfaces **6*a* of the uprights 1 or of the upright window 6 opposite to the adjustable jacks 7. This ensures that, within the range of accuracy of the chocks and uprights, the rolls are situated parallel with each other in the direction of the roll axis. Prior to commencement of the rolling operation, the pistons 8 of the adjustable jacks are then retracted and the chocks 3 are retained in contact with the surfaces 6*a*** exclusively by the force which is obtained from the rolling force.

What is claimed is:

1. A method for operating a rolling mill having at least one roll, said roll being supported in a chock, said chock being situated in a window having upright lateral sides, one of said sides being disposed in the direction of a transverse force component produced by a rolling force during the rolling operation, the method comprising:

moving said chock against said upright side of said window disposed in the direction of said transverse force component produced by said rolling force, by applying a lateral force to said chock prior to commencing said rolling force;

initiating a rolling operation thereby producing said rolling force; and releasing said lateral force whereby said chock is maintained against said upright side due to said transverse force component.

2. The method as set forth in claim 1 and including the step of producing said lateral force by an adjustable chock.

3. The method as set forth in claim 1, wherein said rolling mill comprises a plurality of two high stands in serial configuration, and wherein the step of applying a lateral force includes applying a similar force to each roll chock in said two high stand.

4. The method as set forth in claim 1, wherein the rolling mill includes a plurality of four high roll stands in serial configuration, each of said stands including a pair of working rolls, each of said working rolls being engaged to a backing roll, each of said backing rolls being mounted in a chock, and wherein the step of applying a lateral force comprises applying a similar lateral force to each of said backing roll chocks.

* * * * *